US005259557A

United States Patent [19]

Spriggs et al.

[11] Patent Number: 5,259,557

[45] Date of Patent: Nov. 9, 1993

[54] SOLUTION PROPORTIONER AND DISPENSING SYSTEM

[75] Inventors: John R. Spriggs, Minneapolis; James D. Decker, Apple Valley; James L. Copeland, Burnsville, all of Minn.; John E. Thomas, River Falls, Wis.

[73] Assignee: Ecolab Inc., St. Paul, Minn.

[21] Appl. No.: 32,838

[22] Filed: Mar. 10, 1993

Related U.S. Application Data

[63] Continuation of Ser. No. 765,576, Sep. 25, 1991, abandoned.

[51] Int. Cl.[5] ..... B05B 7/24

[52] U.S. Cl. ..... 239/304; 239/318; 239/526; 222/129; 222/132; 222/145

[58] Field of Search ..... 239/304, 307, 310, 318, 239/526, 569; 222/129, 129.1, 132, 143, 145

[56] References Cited

U.S. PATENT DOCUMENTS

| | | | |
|---|---|---|---|
| 1,610,714 | 12/1926 | Smith | 239/318 X |
| 2,054,136 | 9/1936 | Pfaff et al. | 239/526 X |
| 2,176,507 | 8/1955 | Graves | 222/129.2 |
| 2,993,651 | 7/1961 | Packard | 239/319 |
| 3,037,707 | 6/1962 | Ligon | 239/310 |
| 3,168,967 | 2/1965 | Giampa | 222/129.1 |
| 3,303,800 | 2/1967 | Young | 111/7.1 |
| 3,675,851 | 7/1972 | Merfeld et al. | 239/318 |
| 3,698,644 | 10/1972 | Nystuen | 239/526 X |
| 3,811,618 | 5/1974 | Gartner et al. | 239/312 |
| 3,863,843 | 2/1975 | Hechler, IV | 239/318 |
| 4,142,681 | 3/1979 | Hechler, IV | 239/318 |
| 4,238,074 | 12/1980 | Coons | 239/310 X |
| 4,247,046 | 1/1981 | Hechler, IV | 239/318 |
| 4,254,805 | 3/1981 | Reeder | 141/59 |
| 4,349,154 | 9/1982 | Pacht | 239/569 X |
| 4,527,740 | 7/1985 | Gunzel, Jr. et al. | 239/318 |
| 4,697,610 | 10/1987 | Bricker et al. | 137/3 |
| 4,753,370 | 6/1988 | Rudick | 222/105 |
| 4,901,923 | 2/1990 | McRoskey et al. | 239/123 |
| 4,928,853 | 5/1990 | Isham et al. | 222/129.1 X |
| 4,947,739 | 8/1990 | Owen | 222/132 |
| 5,033,649 | 7/1991 | Copeland et al. | 222/132 |
| 5,042,523 | 8/1991 | Robertson | 137/271 |
| 5,074,438 | 12/1991 | Ingram | 239/526 X |

FOREIGN PATENT DOCUMENTS

| | | |
|---|---|---|
| 0325335 | 7/1989 | European Pat. Off. . |
| 2150427 | 8/1973 | Fed. Rep. of Germany . |
| 1139021 | 6/1957 | France . |
| WO 85/05092 | 11/1985 | France . |
| WO89/09361 | 10/1989 | PCT Int'l Appl. . |
| 780202 | 7/1957 | United Kingdom . |
| 2010105 | 11/1978 | United Kingdom . |

OTHER PUBLICATIONS

Hydro Systems Company; New Product Development: Multiple Product Selector Valve; (No publication date).

Hydro Systems Company; New Product Development: Variable Dilution Selector Valve; (No publication date).

Hydro Systems Company; HydroFoamer Series; Copyright 1988 Automatic Foaming Hose End Liquid Proportioner.

Hydro Systems Company; HydroSprayer Series; Liquid Proportioners; Copyright 1989.

*Primary Examiner*—Andrés Kashnikow

*Assistant Examiner*—William Grant

*Attorney, Agent, or Firm*—Merchant, Gould, Smith, Edell, Welter & Schmidt

[57] ABSTRACT

A system for proportioning and dispensing concentrated liquid products is disclosed. The components of the system's first embodiment are mounted upon a cart (12). A concentrate solution tube (14) is interconnected to a dilution assembly (61) containing an aspirator (26). A water supply assembly (69), containing a valve (75) and backflow preventer (74), is connected to the aspirator assembly (26) when dilution of the concentrated product (13) is desired. A discharge tube (68) carries the diluted product from the aspirator assembly (26) to a container (60). The system's second embodiment has a spray gun assembly (150) containing an aspirator (167), a valve (166), and preferably though not necessarily, a backflow preventer (165). The concentrate pickup tube (114) attaches to the spray gun assembly (150) with a releasable connector (170). The spray gun assembly has a rigid delivery tube (153) for dispensing to large containers (160), and a nozzle tip (180) for attachment to an inlet port (119) of a jug (111). Also disclosed is a method for dispensing and handling solutions.

22 Claims, 10 Drawing Sheets

FIG. 12
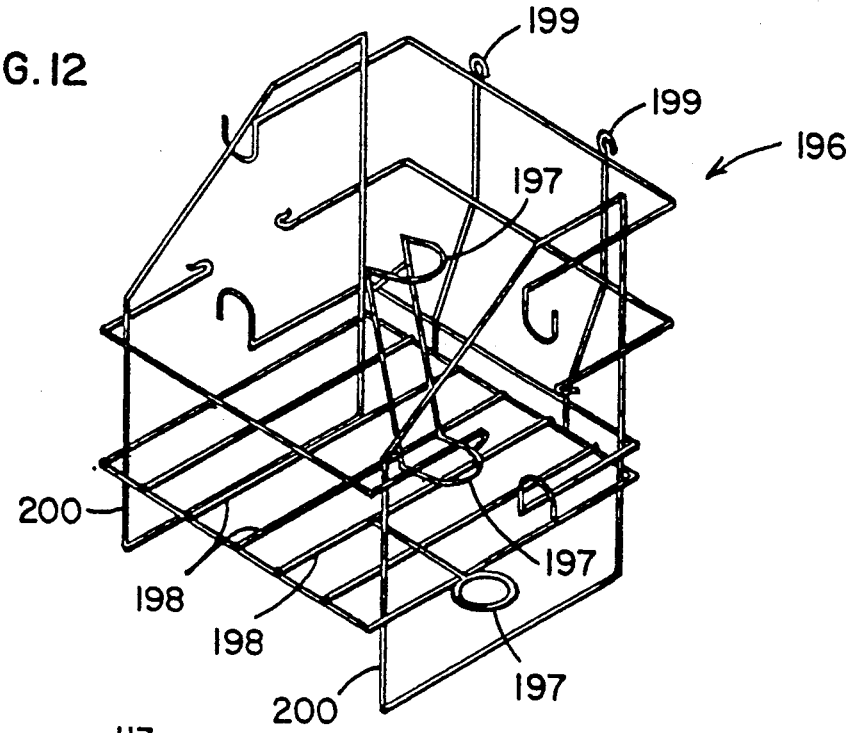
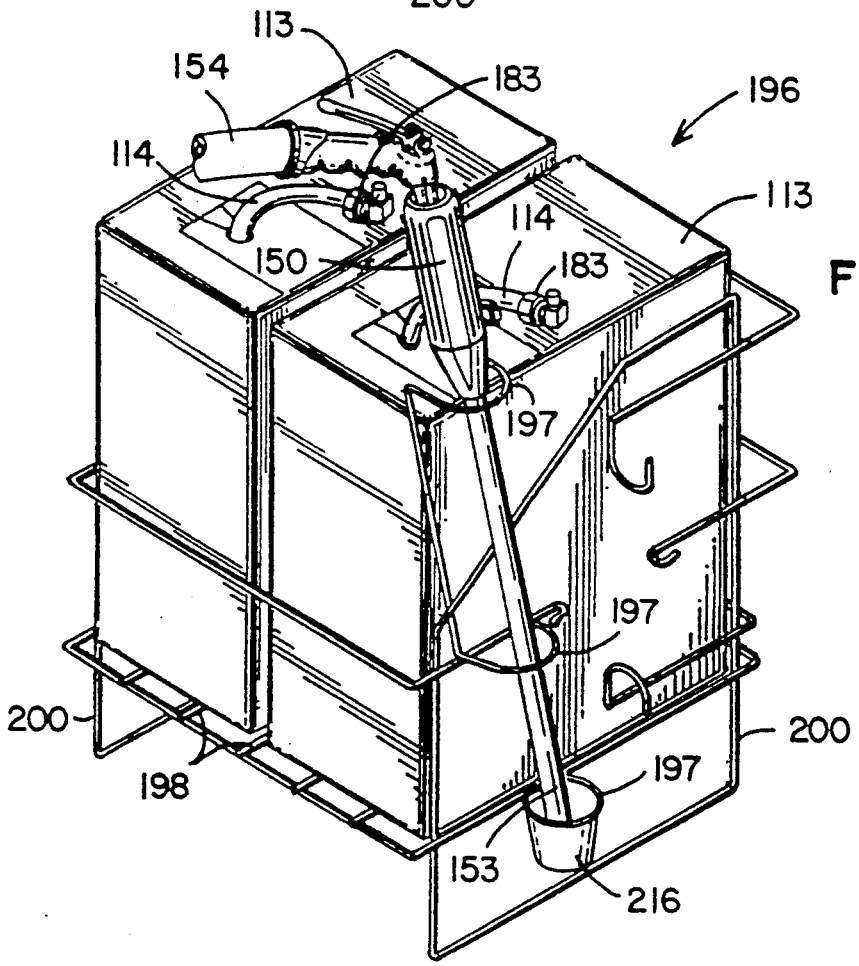
FIG. 13

SOLUTION PROPORTIONER AND DISPENSING SYSTEM

This is a continuation of application Ser. No. 07/765,576, filed Sep. 25, 1991, which was abandoned upon the filing hereof.

FIELD OF THE INVENTION

The present invention relates generally to a system for diluting concentrated liquid products and for dispensing the mixed solution, and more particularly to a system which employs an aspirator to proportionally mix a liquid with water.

BACKGROUND OF THE INVENTION

In janitorial settings which require a significant amount and number of specialized cleaning solutions, the liquid cleaning products are purchased on a concentrated basis, and then are diluted to the proper strength at the site where they will be used. This type of general system is employed by a wide variety of users, e.g., hotels, hospitals, restaurants, etc. Several dispensing systems have been developed for mixing and diluting the concentrated cleaning product. The dispensers usually feature at least some of the following components: a container for the concentrated cleaning product, a storage container for the diluted cleaning product, a method to dose concentrate into the storage container, and a water supply line to dilute the concentrate.

The dispensing systems vary widely in terms of their complexity. That is, the method of dilution may be rather simple and manual in nature, but may require a great deal of operator experience. On the other hand, the dispensing system may be quite complex, requiring several mechanical devices to dilute the concentrates. Such complex systems are often necessary where different cleaning products and different dilution ratios are utilized for different cleaning applications. These dispensing systems typically require several separate water lines, each water line corresponding to a different type of cleaning concentrate. The provision of multiple water lines increases the cost of installation. The requirement of multiple water lines also greatly limits the locations at which the dispensing system can be placed, and such a system is not portable. Accordingly, large containers such as mop buckets and auto scrubbers must be filled and taken to the point of usage by the janitorial personnel.

With one such system, a cabinet is mounted proximate the concentrated liquids and the water source. This cabinet contains a multiplicity of aspirators, backflow preventers and valves for dilution of the concentrates, the number of such devices depending upon the predetermined number established by the cabinet's manufacturer. However, such a system can be relatively complex, inflexible and expensive, especially in situations where only one concentrated liquid is utilized.

The cost of these conventional dispensing stations is relatively high, because of their complexity and because backflow preventers are generally required for each water connection by applicable plumbing codes. Pressure regulators may also be necessary to control use solution concentrations within an acceptable range. Other necessary flow control devices add to the cost of conventional dispensing systems; for example, a pickup probe and foot valve must be employed in order to withdraw the concentrate from a rigid container.

An aspirator is employed with some dispensing systems to withdraw the concentrated cleaning solution from its container. With conventional systems, each water line requires a separate aspirator, and the aspirators are located in a variety of places, such as mounted to the concentrate container or mounted upon the wall adjacent to the dispensing station. These locations of the aspirator add to the complexity and space requirements of the dispensing system.

Another area in which liquid aspirators are commonly employed is the application of diluted solutions to lawns or garden foliage. These diluted solutions contain chemicals such as pesticides, fungicides, herbicides and fertilizers. Typically, sprayers of this type are attached to a garden hose, and the pressure of the water delivered to the hose is used to create a vacuum that causes a chemical solution in the sprayer to be aspirated into the water in order to provide a diluted solution that is subsequently sprayed.

Sprayers of this type include a venturi chamber in which water from the garden hose is mixed with undiluted chemical solution from the sprayer's chemical solution container. In principle, as water passes through the venturi chamber, a syphoning or vacuum action is created by virtue of the velocity of the water passing through the chamber, to draw chemical from the container and into the venturi chamber for dilution with water from the garden hose. Many garden sprayers of this type have a fixed dilution ratio, although some sprayers allow for multiple dilution ratios but are typically of more complex construction, more expensive, and more difficult to use.

Besides their complexity, another drawback of many conventional dispensing systems is that the dilution of the concentrated chemical is inaccurate, resulting in a cleaning product having either too high or too low of a concentration. Many systems have no way of controlling and checking the dilution, so that inaccurate mixing by the janitorial personnel often occurs. Using too much concentrated liquid cleaner is wasteful, unnecessary, and expensive. Over-use of these products also hampers thorough rinsing and leaves messy residues. On the other hand, utilization of too little cleaning concentrate in the use solution will not clean adequately.

The present invention solves these and many other problems associated with currently available dispensing systems.

SUMMARY OF THE INVENTION

The present invention is a solution proportioning and dispensing system. A first embodiment of the apparatus has a dilution assembly which is mounted to a plate. The dilution assembly has two inlet ports for two types of liquids, and the inlet ports are in fluid communication with a proportioning means, such as an aspirator. The proportioning means outlets to a discharge tube. Two inlet lines correspond to the two inlet ports, and each inlet line is removably interconnected to its corresponding port.

Preferably, one of the liquids is water, and the other liquid is a concentrated solution. The water is supplied by means of a water gun assembly which has a valve and backflow preventer therein. The water gun assembly attaches to the water inlet port by means of a releasable, quick connection fitting. The concentrate line attaches to the plate's concentrate inlet port with a similar type of fitting. The concentrate supply container is preferably made of a semi-rigid or flexible material which may be collapsible as the concentrate is withdrawn from the container. The discharge tube outlets to a suitable container, such as a mop bucket.

The second embodiment of the proportioning and dispensing system has a spray gun to which the water supply hose and concentrate supply tube are attached. The spray gun has a valve and proportioning means therein, such as an aspirator. In a preferred embodiment, a backflow preventer is incorporated into the spray gun, but it is not a necessary element of the invention. Different types of concentrated chemical may be interconnected to the spray gun by means of a releasable connector means. The spray gun also has a rigid delivery tube for dispensing of the diluted solution into a relatively large container. Preferably, the delivery tube is removable, so as to expose a nozzle which is attachable to an inlet port of an intermediate-sized storage container.

According to another aspect of the second embodiment's invention, there is disclosed a method for dispensing and handling liquid solutions, in which a concentrate pickup tube is attached to the spray gun; the spray gun's outlet end is positioned into a storage container; and the water control valve is opened so as to draw the concentrate chemical into the spray gun via the pickup tube.

An advantage of the present invention is that it results in cost savings for the user. Because the system is simpler in design, its cost is lower than conventional dispensers. In addition, the inventive dispensing system needs only a single water line and backflow preventer which further reduces the cost of installation. Whereas conventional dispensing systems are quite complex and expensive, the simplicity of the present invention enables it to be low in cost and affordable for even small housekeeping and food service operations. The present invention operates on water power alone, and does not require electrical connections. The various fittings, tubes, and valves are readily accessible and can be repaired easily by any necessary tightening, repair, or replacement measures.

Furthermore, the proportioning system of the present invention is very easy to use. In the spray gun embodiment of the invention, the user can fill either large containers, such as mop buckets, or small containers, such as five gallon jugs, by positioning the spray gun proximate the desired storage container. The filling of the container is a one-handed operation, since the user need only depress the spray gun's water activation lever so as to activate water flow and dispense the use solution. In contrast, prior art systems are typically two-handed operations, with one hand on the water control device and the other hand controlling the output hose.

The present invention also provides considerable flexibility by allowing the user to mix and dispense several different types of cleaning products. The invention can be used for any number of chemical solutions, because the system is completely modular. The supply lines for the various concentrated cleaning products can be connected and disconnected easily, and only a single water line is needed. The modular aspect of the present invention allows the system to be appropriate for a user who has only a single concentrated product to be diluted, as well as multiple products. With the prior art systems, the number of cleaning compositions which could be dispensed is limited to the number of water lines or to a predetermined number of control valves provided in the dispenser. In contrast, the present invention can be utilized with an unlimited number of products by simply providing additional product pickup assemblies.

Another advantageous feature of the present invention is that it is economical. In the first embodiment of the system, a single aspirator assembly may be employed by a user who has only a single concentrated product to be diluted, and the system expands to accommodate multiple aspirators where multiple concentrated products are being diluted. However, even in the latter situation, only a single backflow preventer and valve assembly is required, rather than a separate water line, backflow preventer and valve assembly for each aspirator, as was necessary with prior art systems. In the second embodiment of the system, only a single aspirator, backflow preventer and valve assembly are required, regardless of the number of different concentrated products. This feature allows a cost savings by greatly simplifying and reducing the plumbing requirements.

Another advantageous feature of the present invention is that the certain components of the dispensing system are color-coded and/or labeled to correspond with the particular cleaning product being utilized. This minimizes the chance of contamination and minimizes the likelihood that a particular cleaning product will be used at an improper dilution ratio, thus enhancing the effectiveness of the cleaning product. This feature also results in a cost savings for the user, in that waste of the cleaning product is eliminated when the proper dilution ratio is maintained. The present invention also is safe for the operator, because it minimizes any contact with the concentrated cleaning product.

The dispensing system is also advantageous in that it is able to deliver the cleaning and sanitation products in exact use concentrations. The metering devices contained within the dispensing system assure that the proper dilution ratio is set, thereby obviating the tendency of some janitorial personnel to over-use the product. The use concentrations can be controlled to the precise number of ounces per gallon or parts per million required. This accurate dispensing eliminates product over-use, waste and spilling.

Yet another feature of the system is that it is portable enough to be set up in various locations. Because the sizes of the various components are relatively small, because only a single water line is needed, and because the system is modular, it can be set up close to the point of usage, thereby saving time and effort for the janitorial personnel. The apparatus may be mounted upon a transportable cart assembly so that it is readily portable. The quick connect water assembly requires no plumbing hookup, and can be used at any sink or faucet. With the prior art systems, a plumbing hook-up was required, which restricted the location at which the system could be utilized.

For a better understanding of the invention, and of the advantages obtained by its use, reference should be made to the drawings and accompanying descriptive matter, in which there is illustrated and described a preferred embodiment of the invention.

BRIEF DESCRIPTION OF THE DRAWINGS

In the Drawings, which form a part of the instant specification and are to be read therewith, two optimum embodiments of the invention are shown, and, in the various views, like numerals are employed to indicate like parts:

FIG. 12 is a perspective view of a rack for use with the system illustrated in FIGS. 5-7;

FIG. 13 is a perspective view of the rack illustrated in FIG. 12 with the product containers and spray gun mounted therein.

DETAILED DESCRIPTION OF THE PREFERRED EMBODIMENTS

Figure 1:
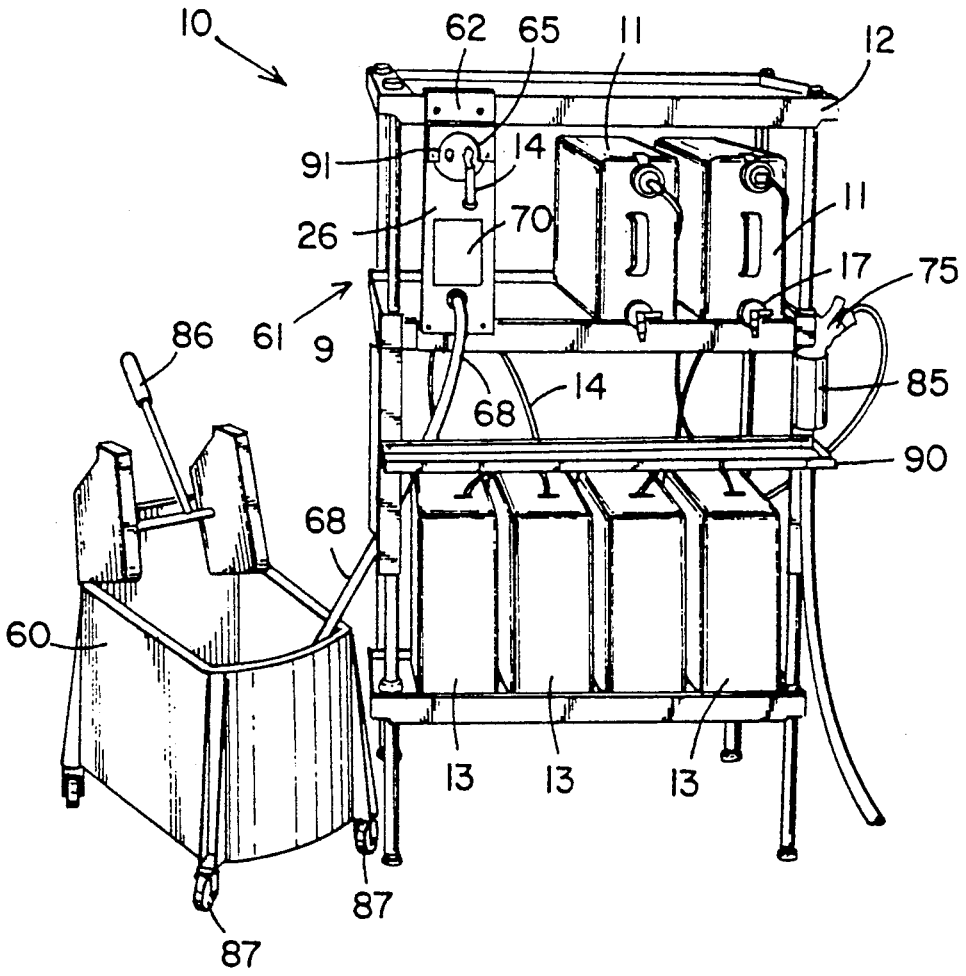
FIG. 1 is a perspective view of the first embodiment of the proportioning and dispensing system of the present invention.

Referring to FIG. 1, a first embodiment of the system for diluting, storing and dispensing solutions is shown generally at 10. The system 10 is preferably supported by a rack or cart 12 which may have wheels (not shown) so as to allow the cart assembly to be moved as necessary after disconnection from the water supply line. The system 10 includes one or more containers 13 for the concentrated solution which, for example, may be concentrated cleaning products. The rack 12 may support one or more containers or jugs 11 which store diluted cleaning product, and the rack 12 has a shelf 90 for supporting spray bottles. Each jug 11 has a spigot 17 which can be opened for filling spray bottles (not shown) which are supported upon a shelf 90. The jugs 11 are preferably approximately three to five gallons in size.

For filling relatively large containers such as the mop bucket 60 shown in FIG. 1, an aspirator assembly 61 is employed. The aspirator assembly 61 is shown in more detail in FIGS. 3 and 4. The aspirator assembly 61 includes proportioning means, which is preferably an aspirator 26, but which could alternatively be an electric or mechanical pump. The aspirator assembly 61 has a water tube (not shown) and a concentrate tube 8, both tubes leading into the aspirator 26. The aspirator 26 is in fluid communication with a discharge tube 68. The aspirator 26 is preferably made of a suitable plastic material such as high density polyethylene.

The aspirator assembly 61 is mounted upon a plate 62, and the plate 62 mounts to the rack 12 by means of a lip 63 along its upper edge and by a plurality of screws 64. Preferably, the plate 62 is made of a metal material. A cylindrical housing 67 surrounds the aspirator 26 and elbow 71, and is also preferably made of a metal material. The aspirator plate 62 is provided with a label 70 which may contain information regarding the corresponding concentrated product.

Figure 3:
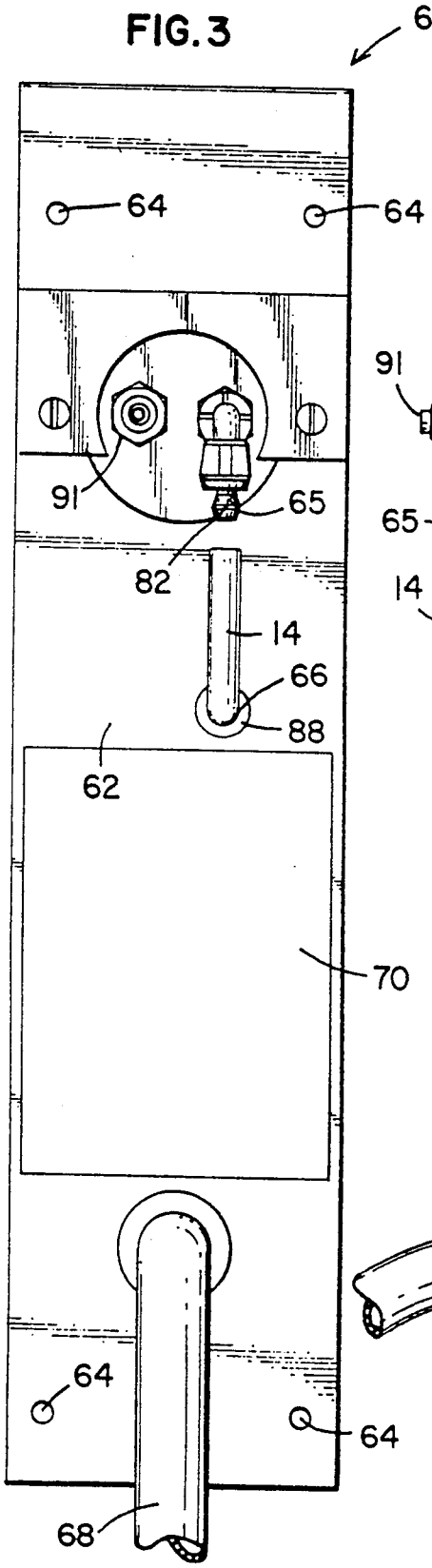
FIG. 3 is a front view of the aspirator plate assembly utilized with the system shown in FIG. 1.
Figure 4:
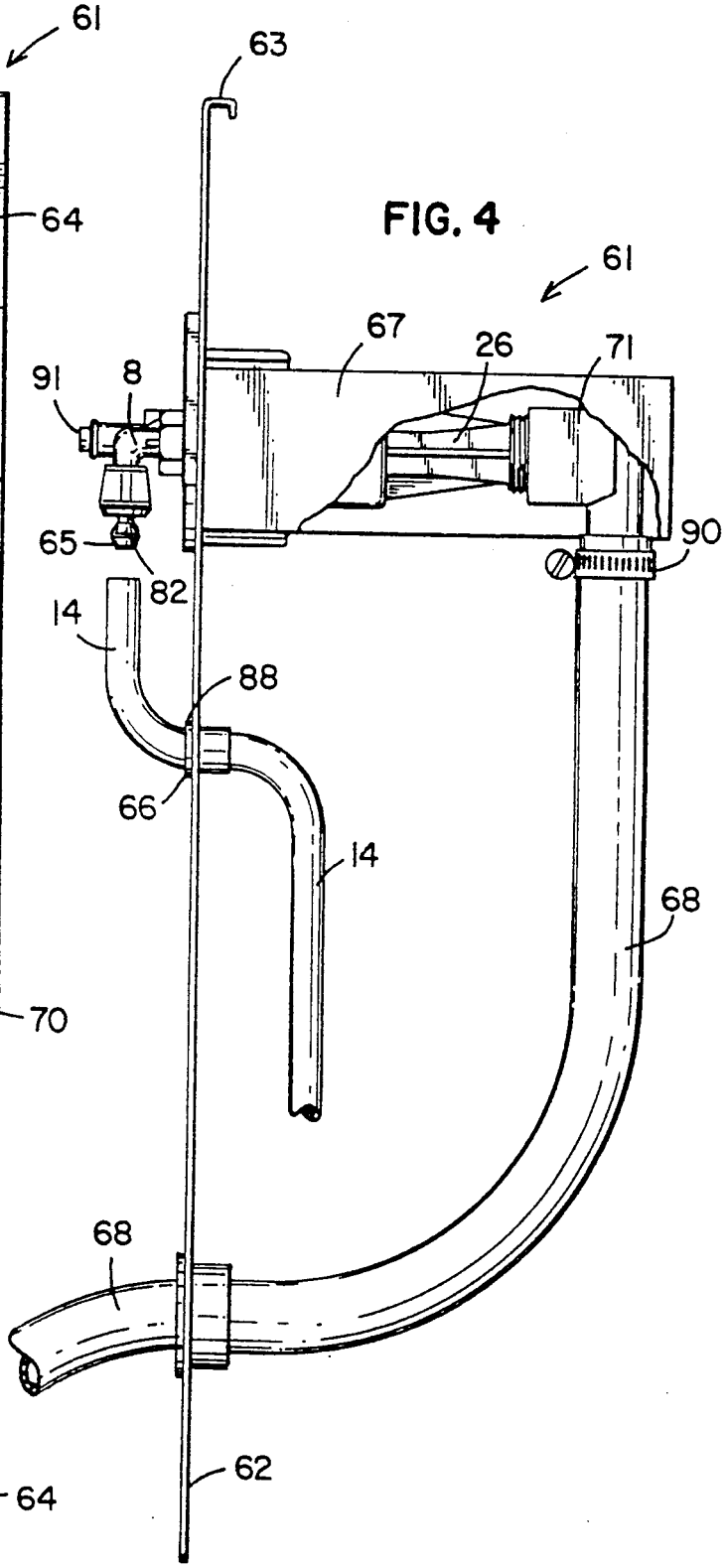
FIG. 4 is a side view of the aspirator assembly shown in FIG. 3.

The aspirator assembly 61 has a port 65 for receiving a product inlet tube 14. In FIGS. 3 and 4, the tube 14 is shown below the port 65 for clarity of illustration; however, in use, the upper end of the tube 14 wraps around the port 65 in tight, sealing engagement. The conduit 14 carries the concentrated liquid from a container 13 to the aspirator assembly 61. The conduit 14 is preferably made of a flexible plastic material which is clear or translucent, such as polyvinyl chloride. This allows the operator to verify when the tube 14 is filled with concentrate 15, and enables the operator to view the metering tip 82, discussed below. It is desirable for the pickup tube 14 to be completely filled and not contain air. The conduit 14 passes through an aperture 66 and bushing 88 in the plate 62 and is connected at its lower end to one of the concentrate containers 13.

The product pickup tube 14 is approximately one-quarter of an inch in inside diameter and is less than approximately ten feet in length. These dimensions allow for adequate aspirator efficiency, and a larger tube diameter would allow for a longer pickup tube 14 to be utilized. A minimum flow pressure of approximately 20 psi should be provided by the water source. The lower end of the pickup tube 14 has a check valve (not shown), such as an umbrella check valve.

A water inlet port 91 is positioned on the plate 62 next to the concentrate port 65. Both the concentrate port 65 and water inlet port 91 are at the front of the aspirator assembly's plate 62, and both are in fluid communication with the aspirator 26, which is located behind the plate 62 in the preferred embodiment In the aspirator 26, the vacuum created by the flow of water is utilized to withdraw the proper proportion of concentrated cleaning solution from the container 13 and through the corresponding pickup tube 14. In this manner, the water and concentrate enter the aspirator assembly's discharge tube 68 simultaneously. The water and concentrate pass through the aspirator 26, and the aspirator's output fills the product use container 11.

An elbow 71 is provided between the outlet end of the aspirator and the discharge tube 68. The outlet tube 68 is attached to the elbow 71 by means of a clamp 90 or other suitable connection means. The discharge tube 68 extends proximate the bottom of the container 60. This allows for underwater dispensing to minimize foaming. The container 60 as illustrated in FIG. 1 is a mop bucket, and the mop bucket 60 has a handle 86 and wheels 87 to facilitate transporting the mop bucket to the point of usage.

Preferably, the discharge tube 68 is translucent or clear so that the user can view the solution as it passes into the mop bucket 60. The discharge tube is preferably made of a flexible, chemical-resistant material such as polyvinyl chloride, and it is approximately one inch in diameter. Dispensing of the diluted solution is at a rate of approximately three to four gallons per minute, and the mop bucket 60 is filled in approximately one to two minutes.

Figure 2:
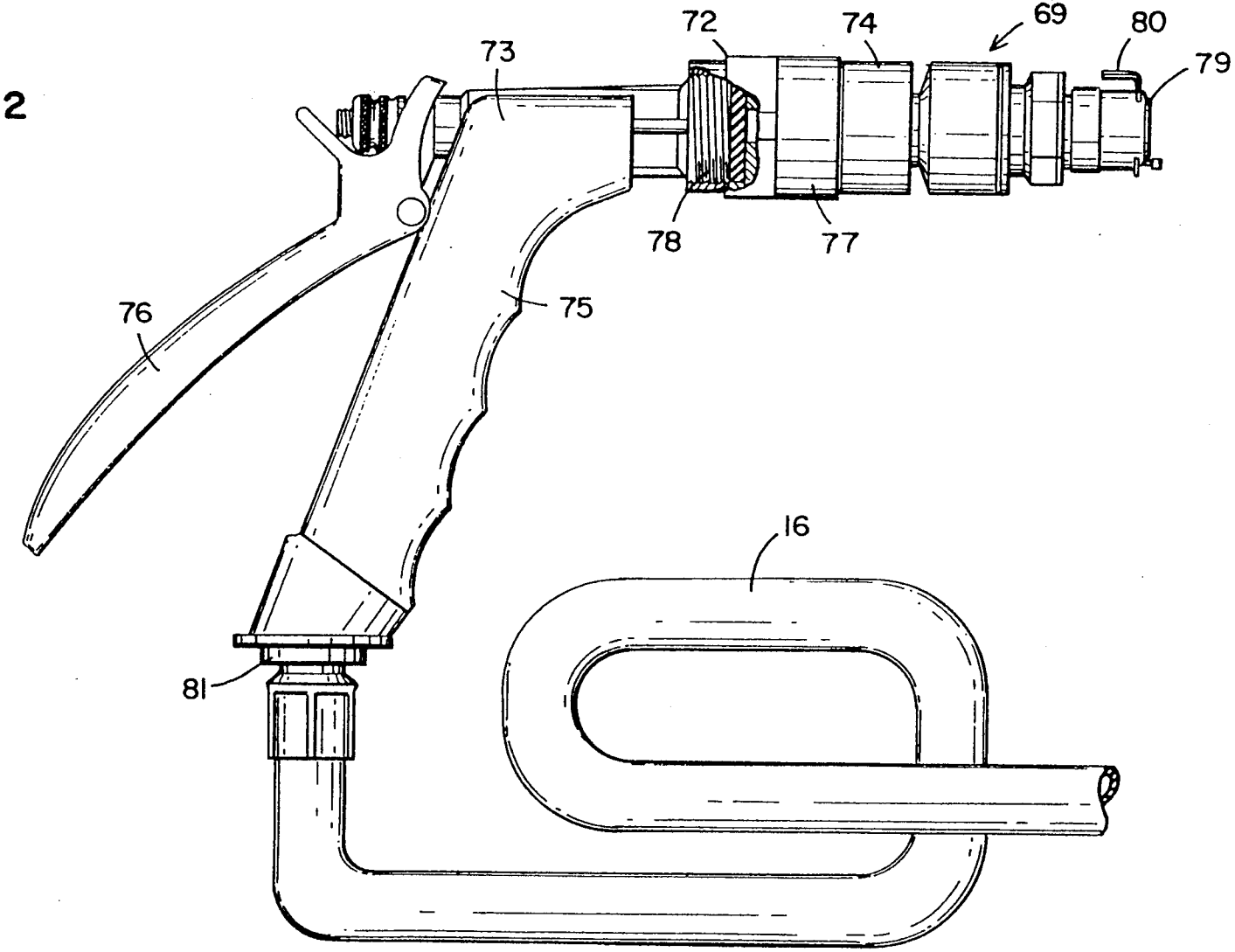
FIG. 2 is a side view of the water supply assembly of the system shown in FIG. 1, partially cutaway.

A water supply gun 69 is illustrated in FIG. 2. The water supply gun 69 includes a water supply line 16 which is interconnected to a faucet (not shown) or other water supply device. In the preferred embodiment, the handle's lower portion is interconnected to the water supply hose 16 by a threaded connection 81. The water hose 16 is preferably approximately six feet in length. Water flow occurs upon activation of a suitable water supply valve. The water supply assembly 69 contains an on-off valve 73 and a backflow preventer 74. These types of devices are governed by the requirements of local plumbing codes. In the preferred embodiment, the water gun 69 is held by a holder 85 mounted upon the rack 12 when the water gun 69 is not in use, as illustrated in FIG. 1.

Preferably, the valve 73 is contained within a handle portion 75 of the water supply assembly. The valve 73 is opened by lowering a lever 76 as the user grasps the handle portion 75. The lever 76 is spring-loaded so that it is biased in a manner such that the valve 73 is normally closed. The barrel portion 77 of the water supply assembly 69 is interconnected to the handle portion 75 by means of a threaded connection 78 and a gasket 72, as shown in the cutaway portion of FIG. 2. The end of the barrel 77 is a quick connect fitting 79 which is sized and configured to correspond to the size of the water inlet port 91. The water supply fitting 79 has a release button 80, the depression of which allows for quick connection and disconnection of the water supply fitting 79 to the water inlet port 91.

Although only one aspirator assembly 26 is mounted upon the rack 12 shown in FIG. 1, it is to be understood that multiple aspirator assemblies 26 could be mounted along the rack 12. This common situation would arise where a user employs more than one type of concentrated cleaning product 13. In this manner, the dilution and dispensing system 10 is highly flexible depending upon the particular number of cleaning products employed by the user. The aspirator assemblies 26 can be mounted either along the front of the rack 12, as shown in FIG. 1, or along one or both sides of the rack 12.

Alternatively, a single aspirator assembly could service more than one concentrate inlet line by the installation of a three-way valve proximate the concentrate inlet port 65. The valve (not shown) could be switched to the desired concentrate line as necessary and would be mounted to the plate 62. It is also possible to disconnect a pickup tube 14 and connect another pickup tube 14 to the concentrate inlet port 65 when a different concentrate is to be diluted and dispensed.

The product concentrate may be contained within a collapsible, bladder type package which is held within a rigid container 13, such as those shown in FIG. 1. Each concentrate package is approximately 2.5 gallons in volume. The cart 12 may be sized and configured to accommodate a plurality of concentrate containers 13, as illustrated in FIG. 1. When utilizing a flexible bladder bag, the pickup tube 14 may be simply attached to an aperture in the bladder bag 13 by means of a threaded connection (not shown). A cap covers the bag's opening when it is not in use. With this design, the concentrate packaging collapses as the concentrate is withdrawn therefrom. The packages are made of any flexible material which is compatible with the chemical concentrate, such as high density polyethylene. Alternatively, a rigid container could hold the concentrate, and the end of the pickup tube 14 could be provided with a suitable pickup probe and foot valve.

Examples of the types of concentrated cleaning solutions which may be utilized with the proportioning and dispensing system are: multi-purpose cleaners, e.g. for walls, windows, tile and hard surfaces; germicidal detergents for disinfecting and sanitizing; floor care products; and specialty products for special cleaning needs. However, it is to be understood that the present invention is not to be limited for use only with cleaning products, but can be utilized to store and dispense any type of solution.

The blend ratio, or proportion of chemical to water, is set by flow metering means, such as interchangeable metering tips 82 (shown in FIGS. 3 and 4). The metering tip 82 is held within the pickup tube's inlet port 65 by a friction fit, and different sized orifices of the metering tips 82 allow for different flow rates of the concentrate. Each metering tip 82 is sized and configured to correspond to a particular proportion ratio. The metering tips 82 are cylindrical in shape and approximately three-eighths of an inch in length, with the tip's internal diameter being governed by the desired flow rate. The metering tip's diameter may be as small as approximately 0.01 inch, with larger diameters corresponding to higher flow rates. The highest flow rate is achieved when no metering tip 82 at all is present in the pickup tube's inlet port 65. The chemical to water ratio for janitorial applications typically has a range of 0.25–15%, with the ratio depending upon the size of the metering tip, the viscosity of the chemical concentrate, and the water pressure.

In the preferred embodiment, the different sized metering tips have different colors and are visible to the user, so that the flow rate can be easily monitored and adjusted. This enables the user to readily determine what the dilution ratio is. Different dilution ratios are sometimes needed for different applications, e.g., one application might require a 1% solution, whereas another application may require a 10% solution of the same product. Alternatively, an adjustable metering screw may be utilized to enable the proportion ratio to be adjusted.

Another feature of the present invention is the use of identification means on the corresponding components of the system 10. Preferably, the liquid concentrate itself, the labels on the concentrate packaging 13, the metering tip 82, and the aspirator assembly's label 70 are all color coded or appropriately labeled.

In operation of the first embodiment illustrated in FIGS. 1–4, the user assembles the modular components by matching the colors or labels on the aspirator assembly 26 and the concentrate container 13. The pickup tube 14 is attached to the concentrate inlet port 65 and the concentrate container 13 at the respective ends. The water gun's end is attached to the water inlet port 91 via the quick connect mechanism 79. The discharge hose 68 is placed within the container 60, such as a mop bucket. The water flow is initiated by activation of the spray gun's water control valve 73, and the concentrate and water pass through the proportioning means, such as an aspirator. The rate of concentrate flow is determined by a metering tip 82 proximate the concentrate inlet port 65. When the container 60 has been filled to a desired level, the water valve 73 is deactivated and the water supply assembly 69 is disconnected and the container 60 can be moved to a remote location if desired.

Figure 5:
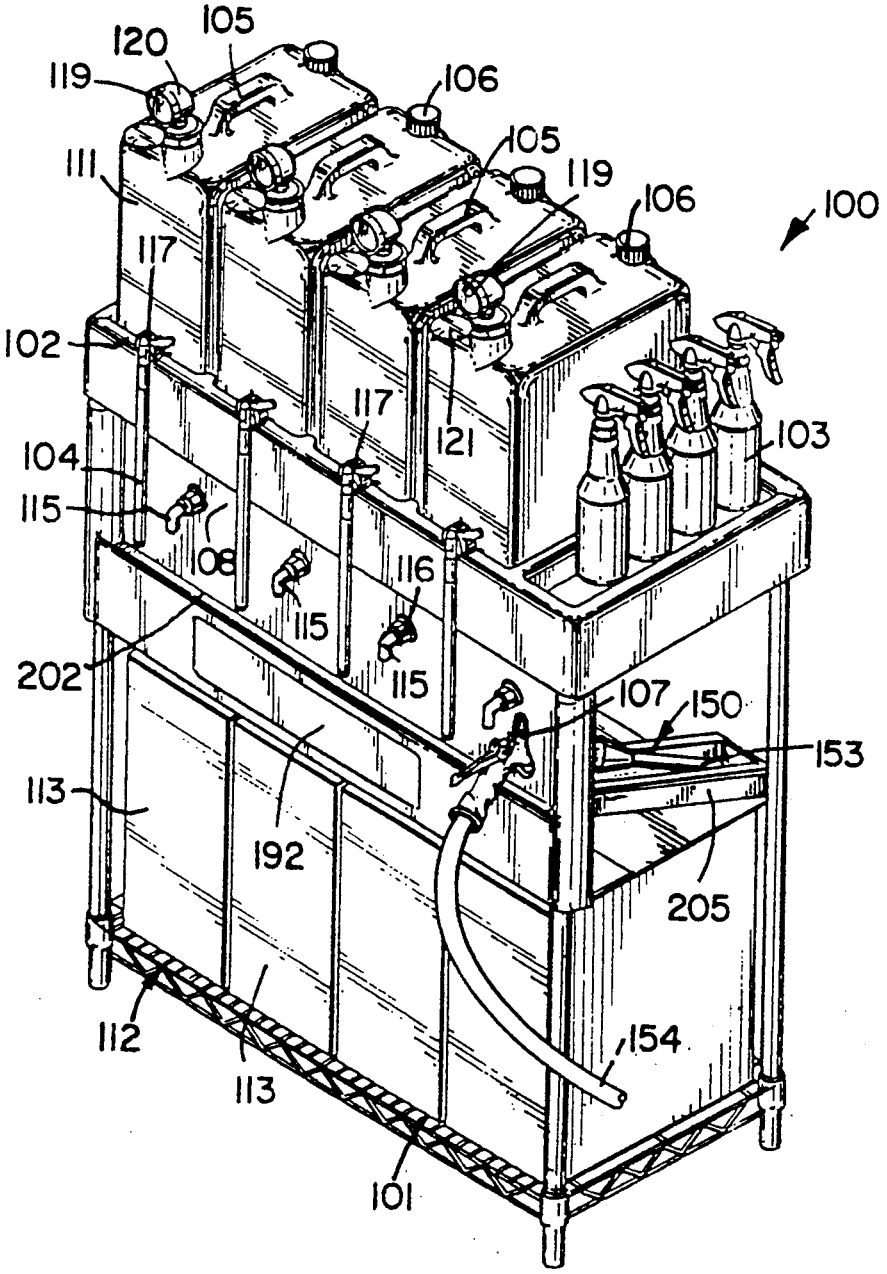
FIG. 5 is a perspective view of the second embodiment of the proportioning and dispensing system of the present invention.
Figure 8:
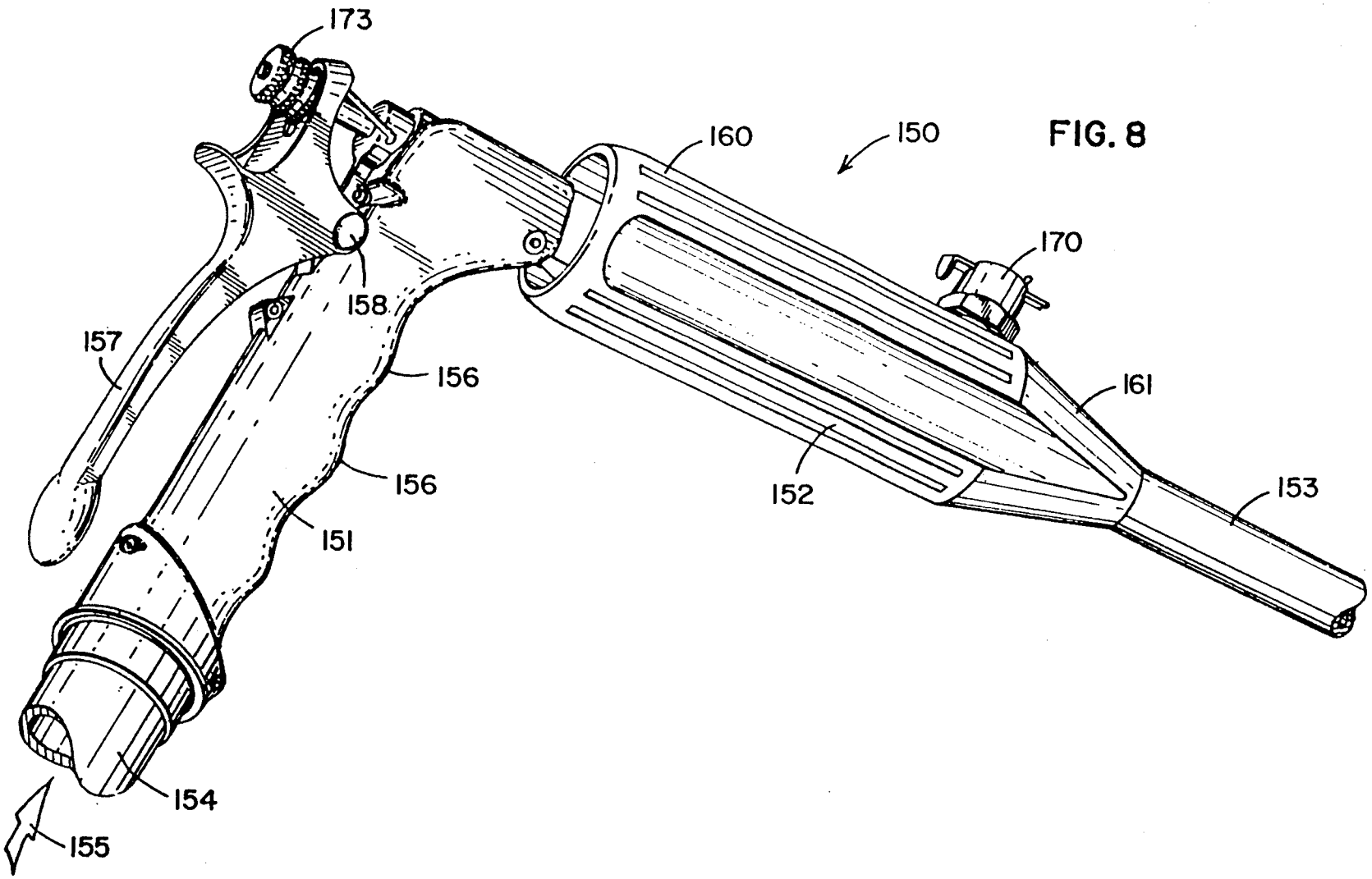
FIG. 8 is a perspective view of the spray gun for the system illustrated in FIGS. 5-7.
Figure 9:
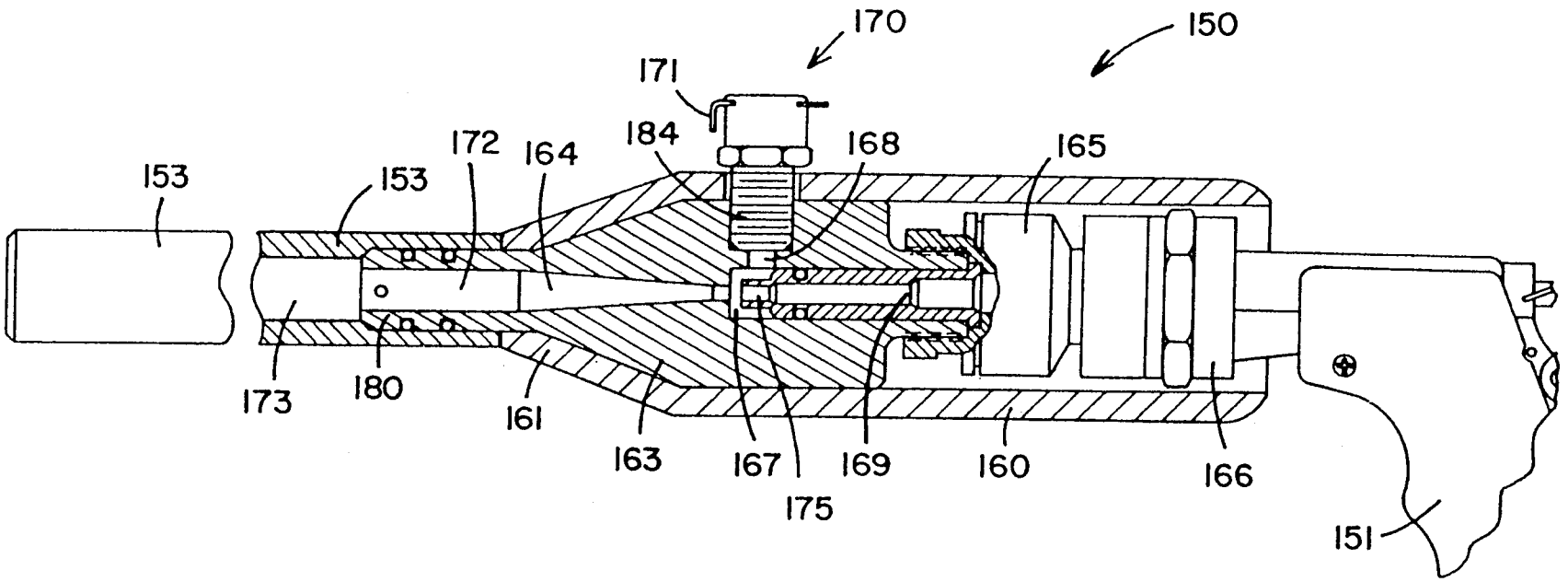
FIG. 9 is a side view, partially in cross-section, of the spray gun illustrated in FIG. 8.
Figure 10:
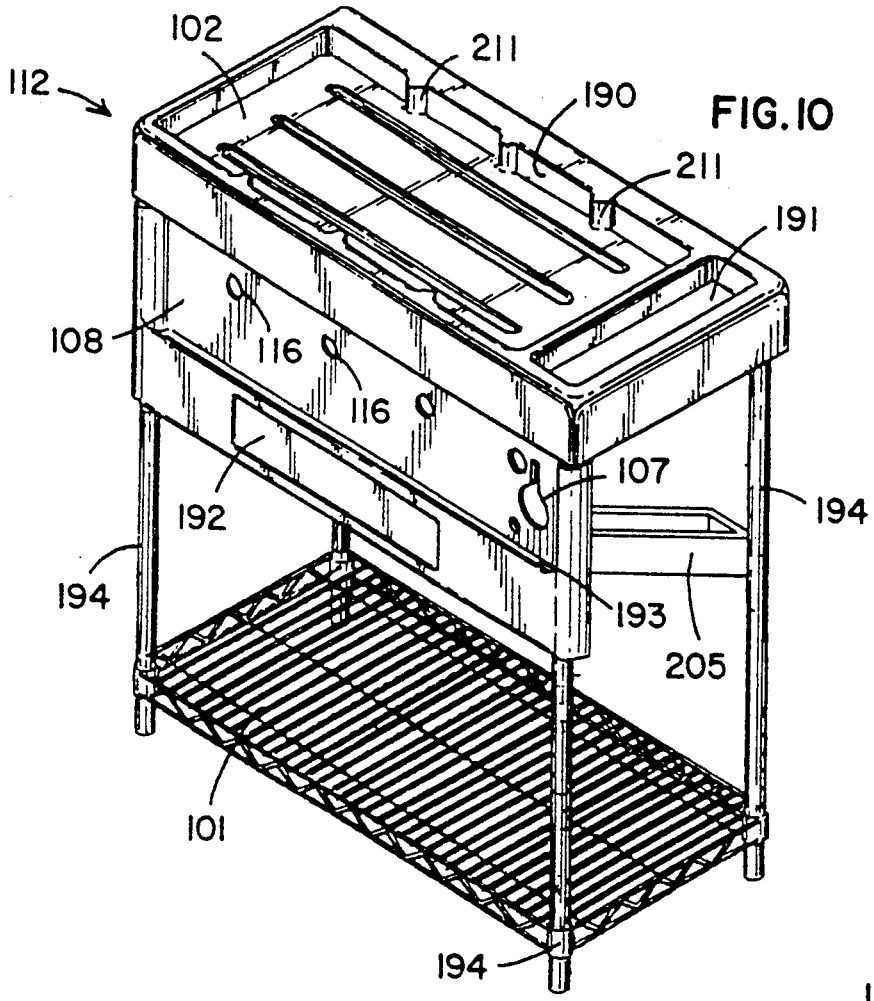
FIG. 10 is a perspective view of the cart utilized with the system illustrated in FIGS. 5-7.

The second embodiment of the proportioning and dispensing system of the present invention is illustrated in FIGS. 5–14. As illustrated in FIGS. 5 and 10, the system 100 has a rack or cart 112. There are one or more concentrate containers 113 which are preferably mounted upon the bottom shelf 101 of the rack 112. The rack 112 also has a top shelf 102, upon which are supported a plurality of jugs 111 and spray bottles 103. The rack's front panel 108 has a plurality of apertures 116 for passage of the various pickup tubes 114, and has a drip tray 202. In the preferred embodiment, the pickup tubes 114 are substantially hidden from view by the rack's front panel 108.

The containers 111, 103 are suitable for storage of the diluted cleaning product. Each jug 111 has an upper handle 105, a cap 106, and a spigot 117. Preferably, the cap 106 has an umbrella check valve for venting of air from the jug 111. Those skilled in the art will recognize that other structures, such as a porous membrane, could also be used to perform this function. An optional outlet tube 104 may be attached to the spigot 117. The tube 104 is sized and configured to correspond to the height of the spray bottle 103, so that the bottom of the tube 104 extends to the bottom of the spray bottle 103 to minimize foaming when the spray bottle 103 is filled from the contents of the jug 111.

Concentrate containers or concentrate packaging 113 are illustrated in FIGS. 5–7 and FIG. 11. The concentrate packaging 113 may be either collapsible and contained within a rigid box, or may themselves have rigid walls. In the preferred embodiment, the container 113 is approximately 12 inches by 12 inches by 6 inches. Each product use container 113 has a pickup tube 114 which extends into the bottom of the container 113. The rack 112 has a front panel 108 having a plurality of apertures 116 through which the pickup tubes 114 may pass. The front panel 108 holds tubes for easy identification and convenience. The lower end of each pickup tube 114 has a check valve (not shown) within the product container 113, such as an umbrella check valve.

There are identification means on the corresponding components of the system. Preferably, the labels on the concentrate packaging 113, the aperture in the front panel 108, the storage jugs 111, and the spray bottles 103 all are color-coded and/or have corresponding labels.

Figure 11:
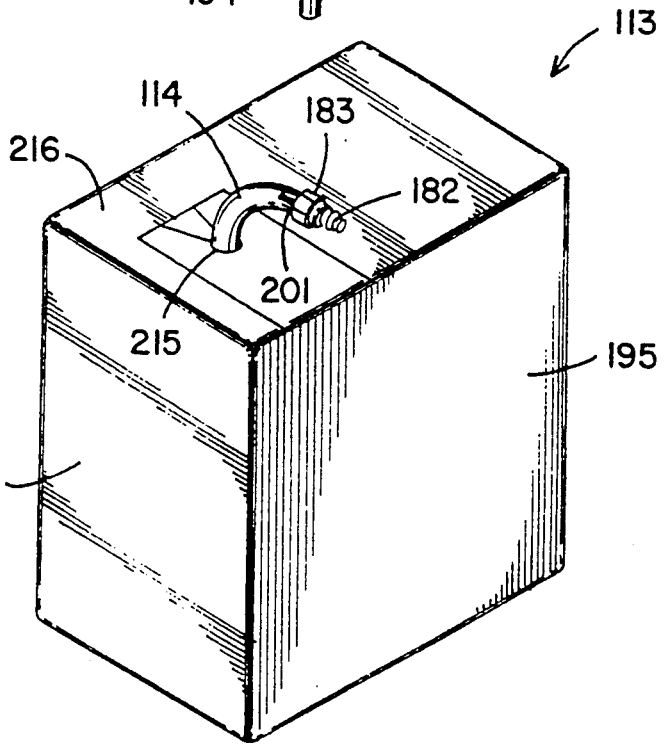
FIG. 11 is a perspective view of the product use container illustrated with both embodiments of the proportioning and dispensing system.

The upper end of each pickup tube 114 terminates in a quick-connect mechanism 115, and preferably has an integrated position activated or quick disconnect valve (not shown). In this manner, the pickup tube 114 is completely closed by having a valve at each end. This allows the pickup tube 114 to be disconnected without spillage of any solution. As shown in FIG. 11, the pickup tube 114 is provided with a suitable metering tip 201, as described above in conjunction with the first embodiment.

Figure 6:
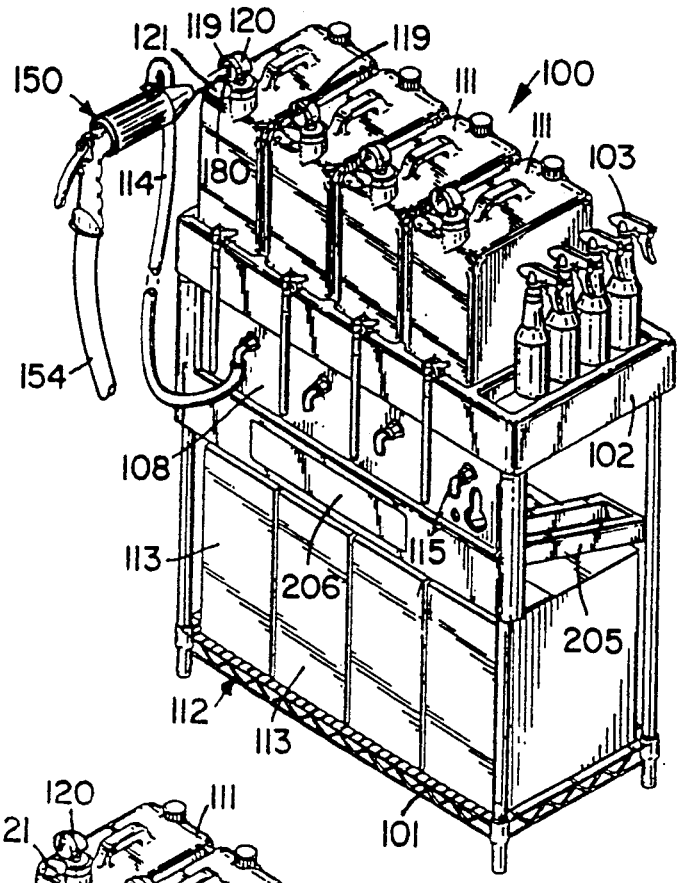
FIG. 6 is a perspective view of the system shown in FIG. 5, with the spray gun assembly in position for the filling of relatively compact jugs.
Figure 7:
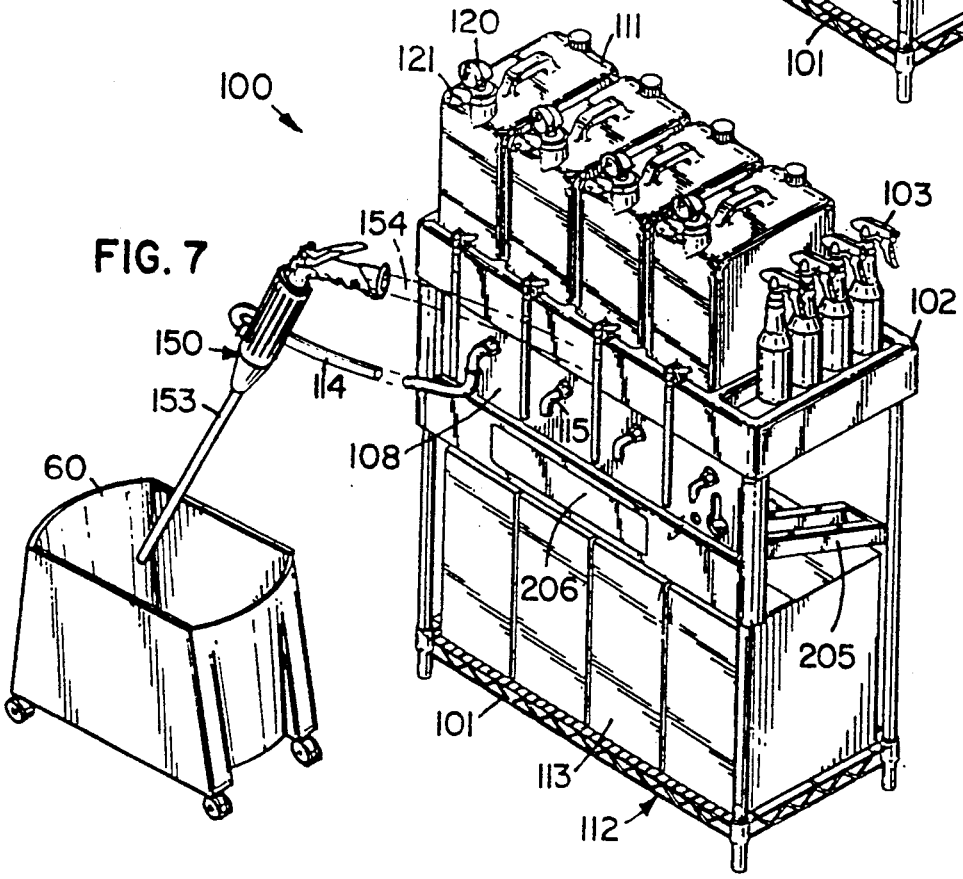
FIG. 7 is a perspective view of the system illustrated in FIGS. 5 and 6 with the spray gun assembly in position to fill relatively large containers.

As shown in FIGS. 5–7, the second embodiment's proportioning and dispensing system 100 also features a spray gun assembly 150. The spray gun means 150 has a rigid outlet member 153, which is preferably removable from the spray gun 150. The spray gun 150 is attached to a water supply hose 154 which is interconnected to a suitable water source (not shown). The spray gun assembly 150 is illustrated in FIG. 5 as being in its stored position in which the spray gun 150 hangs within a holster, which is preferably a sloped trough 205 positioned behind an aperture 107 formed within the front panel 108.

The proportioning and dispensing system 100 has the ability to fill either relatively compact containers 111, as illustrated in FIG. 6; or relatively large containers 60, as illustrated in FIG. 7. When a jug 111 is being filled, the discharge tube 153 is removed from the spray gun assembly 150, the delivery tube 153 is removed, and the spray gun's nozzle tip 180 is interconnected to an inlet port 119 of the jug 111. In the preferred embodiment, this is accomplished by means of a friction fit between the spray gun's nozzle tip 180 and the inlet port 119. For other applications, the spray gun assembly 150 and delivery tube 153 may be positioned within a mop bucket 160 or other relatively large container for the dispensing of the diluted solution, as shown in FIG. 7.

The jug's inlet port 119 is formed within an entrance port member 120 proximate the upper surface of the jug 111. The cylindrical member 120 has a downward slope for drainage of solution into the jug 111. The entrance port 120 has a hinged cap 121 which is closed when the spray gun assembly 150 is not attached thereto, although the caps 121 are illustrated in the open position in FIGS. 5–7 for purposes of illustration.

FIGS. 8 and 9 illustrate the spray gun 150 utilized with the system's second embodiment. The spray gun 150 has a handle 151 and a barrel portion 152. The rigid outlet tube 153 is removably interconnected to the barrel 152. The end of the handle 151 is attached to a water supply conduit 154, and the water enters the handle assembly as shown by the arrow 155. The end of the handle 151 may be provided with a filter or strainer (not shown) to prevent large particles of foreign matter from entering the sprayer 150. The handle 151 is shaped with contours 156 for the user's fingers.

The spray gun 150 has a water control valve or shut-off valve 166 like the valve 73 on the spray gun assembly 69 described for the first embodiment. To initiate water flow, the lever 157 is pivoted to the handle's casing at 158 and bears against a cap 173 threaded on the outer end of the valve stem 159, so that by manually pressing on the lever 157, the valve 166 will be removed from its valve seat (not shown) to permit the flow of water. A stop (not shown) of suitable shape may be interposed to prevent the valve from closing, or the operator may hold down on the lever 157 during the entire time while dispensing is desired. Various other constructions may be employed for controlling the water flow and for withdrawing of the concentrate from the container 113.

In the preferred embodiment, the barrel housing 152 has a cylindrical portion 160 and a frustoconical portion 161. Mounted upon the cylindrical portion 160 is a connector 170 for the concentrate's pickup tube 114. The outlet end of the frustoconical portion 161 terminates in the outlet tube 153, and the outlet tube 153 is preferably removable from the rest of the spray gun assembly. The tube 153 is attached to the spray gun assembly 150 by a friction fit or a bayonet-type connection. The outlet tube 153 allows for a flow rate of approximately three to four gallons per minute. Alternatively, a restricting orifice (not shown) could be attached to the spray gun assembly to form a sprayer which would dispense the solution at a higher pressure.

As shown in FIG. 9, the spray gun 150 has a venturi body 163 within it, the venturi body 163 having a passageway 164 extending through it. The venturi body 163 has a nozzle tip 180 which is sized and configured to correspond with the inlet ports 119 on each jug 111. This attachment to an inlet port 119 is accomplished by means of a frictional fit or other connector mechanism which allows for quick release.

Municipal codes generally require a backflow preventer in systems such as the present invention. The backflow preventer may be remote to the system or incorporated therein. In a preferred embodiment, a backflow preventer 165 is disposed in the spray gun's passage within the cylindrical housing 160. The backflow preventer device mounts completely within the spray gun assembly 150. The backflow preventer 165 may be an atmospheric vacuum breaker or a dual check valve with intermediate vacuum breaker and relief vent. The vacuum breaker 165 prevents flow of concentrated chemical into the water hose 154 if a sudden drop in the hose water pressure should occur. In the absence of this anti-siphon device 165, transitory forces caused by aspiration, siphoning, etc., might draw some of the liquid concentrate back through the hose 154 where it might possibly pollute the water supply.

Proximate the backflow preventer 165 is an aspirator means 167, which may take many forms. A product inlet channel 168 terminates at the aspirator 167, thereby allowing the concentrated cleaning product to be drawn into the spray assembly 150 when water flows therethrough. In this embodiment, a venturi throat 175 is provided in the conduit 169 between the backflow preventer 165 and aspirator 167, for drawing the liquid concentrate from the product container 113 up through the flexible pickup tubing 114 by suction. The concentrate channel 168 has a concentrate suction port, which communicates with passage 175. Downstream from the constricted passage 175 is a larger straight passage 218, a diffuser passage 164, a straight passage 172, and a relatively large passage 173 formed in the extension member 153. The diffuser passage widens at approximately a ten degree included angle. The constricted passage 175 is approximately 0.15 inches in diameter, and the downstream passage 218 is approximately 0.187 inches in diameter.

Figure 14:
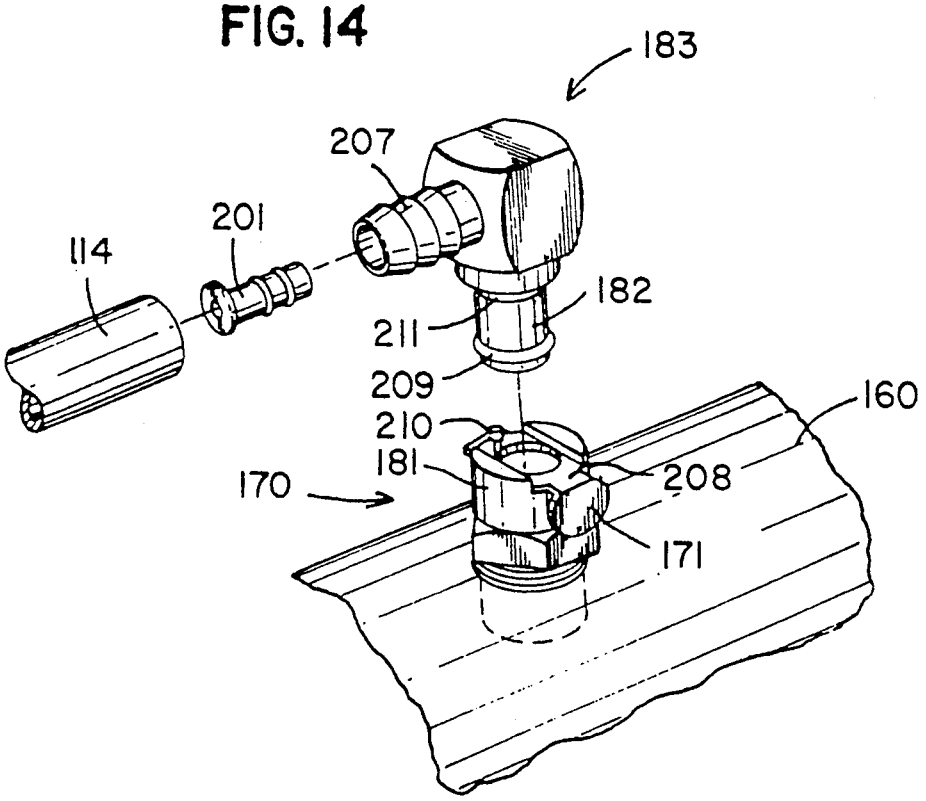
FIG. 14 is an enlarged, exploded view of the connection between the spray gun and the pick-up tube.

The product pickup tube is in fluid communication with the spray gun's channel 168 via the quick-connect mechanism 170. The connector end of the pickup tube 114 snaps into the connector 170, and can be released by depression of a button 171. The connector 170 is attached to the spray gun 150 through a threaded member 184. As illustrated in FIG. 14, the quick-connect mechanism 170 consists of a female member 181 extending through the wall 160 of the spray gun 150, and a male member 182 on the connector 183 of the product pickup tube 114. The male member 182 preferably includes a valve (not shown). The pickup tube connector 183 has a ribbed member 207 over which the end of the pickup tube 114 is secured. In the preferred embodiment, a valve (not shown) is integrated into the housing of the male member 182 to minimize spillage. The female member 181 has a lock ring 208 which snaps onto an annular ring 211 in the male member. A release button 171 is provided on the female member 181 to allow for disconnection. The lock ring 208 is spring-biased into a locked position. When the members 181, 182 are brought into engagement, a flange 209 on the male member 182 pushes against a pin 210 on the female member 181 which causes movement of the lock ring 208 into engagement with the male member's annular ring 211. Depression of the button 171 moves the lock ring 208 out of engagement, to release the connection.

FIG. 10 illustrates a preferred embodiment of the rack 112. Preferably, the rack is rather compact in size; i.e., approximately thirty inches in length and fourteen inches wide. In the preferred embodiment, the rack's shelves and front panel are made from vacuum-formed plastic. The rack 112 has an upper shelf 102, bottom shelf 101, and front panel 108. The cart 112 is supported by four legs 194. The upper shelf 102 has recessed portions which may be utilized for supporting the jugs 111, with contoured side walls 190 and notches 211 for stable positioning of the jugs 111. In addition, the upper shelf 102 may be provided with a recessed portion 191 which may accommodate spray bottles or other items.

The front panel 108 has a plurality of apertures 116 for the product pickup tubes 114 and a holster aperture 107 for the spray gun 150. The holster 205 is sized and configured to accommodate the spray gun barrel and outlet tube 153. In addition, the front panel 108 contains a portion for attachment of a suitable label 192. The front panel 108 also contains a horizontal drip tray portion 202 for catching any drips which may occur when spray bottles are filled from the jugs 111.

FIG. 11 illustrates a concentrated solution's container 113. The container 113 has rigid walls 195, within which is the concentrated solution. The concentrated solution may be held within a flexible bladder bag (not shown) inside the container 113. An aperture 215 in the top wall 216 of the container 113 permits passage of the pickup tube 114. Alternatively, the container 113 may have an aperture and fitting in a side wall near the bottom (not shown). With this design, the pickup tube 114 extends up the side of the container 113.

FIGS. 12 and 13 illustrate a portable rack 196 which may be utilized with the second embodiment's system. The rack 196 is sized and configured to accommodate two of the concentrate storage containers 113. The rack 196 contains rings 197 which serve as a holder for the spray gun 150. Preferably, there is also a drip cup 216 on the rack 196.

The rack 196 is preferably made of wire and has a plurality of parallel members 198 which form a support floor for the containers 113. The rack 196 may have outwardly slanting members 217, which provide clearance between the rack 196 and container 113 in the event the pickup tube 114 extends up the outside of the container 113 as described above. The rack 196 also has hooks 199 for mounting of the rack 196 upon a wall, if desired. The rack 196 may be provided with wheels (not shown) to facilitate portability. The rack 196 is suitable for situations in which the user is to fill relatively large containers such as mop buckets 60, and the rack 196 allows the user to transport the dispensing system near the point of usage, at which point the water supply hose may be connected to the nearest faucet or other water supply mechanism. The rack 196 preferably supports the containers 113 slightly above floor level by support members 200 to keep the containers 113 dry.

In operation of the second embodiment illustrated in FIGS. 5–13, the user attaches the desired product pickup tube 114 to the spray gun assembly 150 by means of the quick-release connectors 170 and 183. If dispensing into a large container such as a mop bucket 160 is desired, the rigid delivery tube 153 is attached to the spray gun assembly 150 and directed into the mop bucket 160. Water flow is initiated by opening of the water control valve 166. The concentrate and water pass through the aspirator 167, and the rate of concentrate flow is controlled by a metering tip 201 in the pickup tube 114. When the container 160 has been filled to a desired level, the water supply is disconnected and the container 160 can be moved to a remote location.

To utilize the proportioning and dispensing system to fill the jugs 111, the delivery tube 153 is removed, so as to expose the venturi body 163. The nozzle tip 180 is inserted into the jug's inlet port 119, and water flow is initiated as described above. When the jug 111 has been filled to a desired level, the water valve 166 is closed, and the jug 111 may be moved to a remote location. The jug 111 may also be utilized to fill spray bottles 103. In addition, a portable cart 196 may be used for moving more than one concentrate container 113 and the spray gun assembly 150 to a remote location.

Even though numerous characteristics and advantages of the invention have been set forth in the foregoing description, together with the details of the structure and function of the invention, the disclosure is illustrative only, and changes may be made in detail, especially in matters of shape, size, and arrangement of parts, within the principles of the invention, to the full extent indicated by the broad, general meaning of the appended claims.

What is claimed is:

1. A system for diluting and dispensing a chemical, comprising:

(a) gun means attached to and in fluid communication with a diluent supply hose which carries a diluent, said gun means including an aspirator, a backflow preventer, and a valve for controlling flow of diluent, said aspirator, backflow preventer and valve being located within said gun means, said valve being controlled by an actuator operably attached to said gun means, said gun means further including a releasable quick connector means for connecting and disconnecting a concentrate supply tube; and (b) at least two concentrate containers, each containing a concentrated chemical, wherein said concentrate containers are positioned on a support means, one end of a concentrate supply tube extending into each of said concentrate containers, wherein said support means includes a holder sized and configured to accommodate said gun means when said gun means is in a non-use position; and wherein when one of said concentrate supply tubes is connected to said gun means and said actuator opens said valve, the concentrated chemical within the concentrate container which is fluidly connected to said gun means flows through said aspirator into said gun means and is dispensed therefrom in diluted form.

2. The diluting and dispensing system according to claim 1, wherein said diluent is water.

3. The diluting and dispensing system according to claim 1, wherein said gun means includes a rigid delivery tube.

4. The diluting and dispensing system according to claim 3, wherein said rigid delivery tube is removable from said gun means.

5. The diluting and dispensing system according to claim 1, further comprising a storage container, positioned upon said support means, said storage container having an inlet port.

6. The diluting and dispensing system according to claim 5, wherein said gun means includes a nozzle sized and configured to correspond to said storage container's inlet port.

7. The diluting and dispensing system according to claim 6, wherein at least one of said concentrate supply tubes includes metering means.

8. The diluting and dispensing system according to claim 7, wherein said metering means comprises a metering tip, said metering tip being color-coded to correspond to a particular dilution ratio.

9. The diluting and dispensing system according to claim 5, wherein a shelf of said supporting means includes contoured ridges to conform with the size and configuration of said storage container.

10. The diluting and dispensing system according to claim 5, wherein one of said concentrate containers, a front panel of said support means, and said storage container have corresponding identification means.

11. The diluting and dispensing system according to claim 1, wherein said support means includes a front panel having a plurality of apertures, each of said apertures corresponding to a concentrate supply tube and being sized and configured for passage of said concentrate supply tube therethrough.

12. A system for diluting and dispensing a chemical, comprising:

(a) a plurality of concentrate storage containers for storing concentrated chemicals, each of said storage containers having a pickup tube extending therefrom, said concentrate storage containers being supported upon shelf means;

(b) dispensing gun means having a first water inlet end and a second outlet end, said dispensing gun means including a valve for controlling water flow, said valve being controlled by an actuator operably attached to said dispensing gun means, said dispensing gun means further including:

(i) an aspirator within said dispensing gun means, (ii) a releasable connector means for releasably connecting to one of said pickup tubes, (iii) a delivery tube, and (iv) a gun nozzle, said delivery tube being connected to said gun nozzle, and said shelf means including mounting means for releasably mounting said dispensing gun means when said dispensing gun means is in a non-use position;

(c) a water hose connected to said first water inlet end;

(d) metering means in at least one of said pickup tubes; and (e) a drum for storing diluted chemical, wherein when one of said pickup tubes is connected to said dispensing gun means and said actuator opens said valve, the concentrated chemical within the concentrate storage container which is fluidly connected to said dispensing gun means flows through said aspirator into said dispensing gun means forming a diluted chemical, and said delivery tube being insertable within said drum for dispensing of said diluted chemical.

13. The diluting and dispensing system according to claim 12, further comprising a plurality of jugs for storing diluted chemical, each of said jugs having an inlet port sized and configured to correspond to said gun nozzle for dispensing of said diluted chemical, said jugs being supported upon said shelf means while said diluted chemical is being dispensed therein.

14. The diluting and dispensing system according to claim 13, wherein a shelf of said shelf means includes contoured ridges to conform with the size and configuration of said jugs.

15. The diluting and dispensing system according to claim 14, wherein said shelf means includes a front panel having a plurality of apertures, each of said apertures corresponding to one of said pickup tubes and being sized and configured for passage of said pickup tube therethrough.

16. The diluting and dispensing system according to claim 15, wherein said concentrate storage containers, said front panel, and said jugs have corresponding identification means.

17. The diluting and dispensing system according to claim 12, wherein said metering means comprises a metering tip which is color-coded to correspond to a particular dilution ratio.

18. The diluting and dispensing system according to claim 12, wherein said delivery tube is rigid and removable from said gun means.

19. The diluting and dispensing system according to claim 12, wherein said mounting means includes a holster sized and configured to accommodate said gun means.

20. A method for dispensing and handling liquid solutions, comprising the steps of:

(a) removing a gun from a holder on a shelf means;

(b) interconnecting a first concentrate pickup tube to said gun with a quick connect means, said gun being in fluid communication with a water supply and having a water control valve and aspirator therein;

(c) positioning an outlet end of said gun into a container; and (d) opening said water control valve by pressing an actuator connected to said gun, thereby drawing a concentrated chemical into said gun via said pickup tube and dispensing the resulting liquid solution into the container.

21. The method for dispensing and handling liquid solutions according to claim 20, further comprising the steps of disconnecting said first concentrate pickup tube from said gun, and connecting a second concentrate pickup tube to said gun.

22. The method for dispensing and handling liquid solutions according to claim 20, further comprising the step of transporting said shelf means proximate a point of usage.

* * * * *